US009016362B2

(12) United States Patent
Hult

(10) Patent No.: US 9,016,362 B2
(45) Date of Patent: Apr. 28, 2015

(54) POLISH ROD LOCKING CLAMP

(75) Inventor: Vern A. Hult, Calgary (CA)

(73) Assignee: Oil Lift Technology Inc. (CA)

( * ) Notice: Subject to any disclaimer, the term of this patent is extended or adjusted under 35 U.S.C. 154(b) by 0 days.

(21) Appl. No.: 10/960,601

(22) Filed: Oct. 7, 2004

(65) Prior Publication Data

US 2005/0045323 A1 Mar. 3, 2005

Related U.S. Application Data

(62) Division of application No. 09/878,465, filed on Jun. 11, 2001, now Pat. No. 6,843,313.

(30) Foreign Application Priority Data

Jun. 9, 2000 (CA) ..... 2311036

(51) Int. Cl.
*E21B 33/06* (2006.01)
*E21B 33/08* (2006.01)
*E21B 43/12* (2006.01)

(52) U.S. Cl.
CPC ..... *E21B 33/085* (2013.01); *E21B 43/126* (2013.01)

(58) Field of Classification Search
USPC ..... 403/373, 374.2, 374.3; 166/82.1, 84.3, 166/84.4, 85.4, 86.2; 277/235; 251/1.1
See application file for complete search history.

(56) References Cited

U.S. PATENT DOCUMENTS 778,591 A * 12/1904 Layne ..... 277/325
1,048,705 A 12/1912 Kleffman
1,498,610 A 6/1924 Cameron
1,569,247 A 1/1926 Abercrombie et al.
1,578,696 A 3/1926 Wright
1,590,160 A 6/1926 Gluyas
RE16,607 E * 5/1927 Crowell ..... 277/344
1,664,709 A 4/1928 Severns et al.
1,812,297 A * 6/1931 Bertel ..... 277/325

(Continued)

FOREIGN PATENT DOCUMENTS

CA 1018065 A1 9/1977
CA 1153307 A1 9/1983

(Continued)

OTHER PUBLICATIONS

Manual from Texas Oil Tools for their EH 44 Dual Combi Blow Out Preventer, Series E Tech Unit 1231 Rev. D, Issue Date: May 1993, Rev. Date: Jan. 2005.

(Continued)

*Primary Examiner* — Gregory Binda
*Assistant Examiner* — Nahid Amiri
(74) *Attorney, Agent, or Firm* — Lerner, David, Littenberg, Krumholz & Mentlik, LLP

(57) ABSTRACT

A pump drive head for a progressing cavity pump comprises a top mounted stuffing box rotatably disposed around a compliantly mounted standpipe with a self or manually adjusting pressurization system for the stuffing box. To prevent rotary and vertical motion of the polish rod while servicing the stuffing box, a polished rod lock-out clamp is provided with the pump drive head integral with or adjacent to a blow-out-preventer which can be integrated with the pump drive head to save space and cost. A centrifugal backspin braking system located on the input shaft and actuated only in the backspin direction and a gear drive between the input shaft and output shaft are provided.

9 Claims, 12 Drawing Sheets

(56) References Cited

U.S. PATENT DOCUMENTS

| | | | | | |
|---|---|---|---|---|---|
| 1,834,921 | A | * | 12/1931 | Abercrombie | 277/325 |
| 1,855,347 | A | | 4/1932 | Goble | |
| 1,886,340 | A | * | 11/1932 | King | |
| 1,910,698 | A | * | 5/1933 | King | |
| 2,090,206 | A | * | 8/1937 | King | 277/325 |
| 2,113,529 | A | * | 4/1938 | Hild | 277/325 |
| 2,144,403 | A | | 1/1939 | Davidson | |
| 2,173,355 | A | | 9/1939 | Criswell | |
| 2,194,254 | A | * | 3/1940 | King et al. | 277/325 |
| 2,218,093 | A | * | 10/1940 | Penick et. al. | 277/325 |
| 2,246,709 | A | * | 6/1941 | Allen | 277/325 |
| 2,280,581 | A | | 4/1942 | Hartley | |
| 2,282,363 | A | * | 5/1942 | King | 277/325 |
| 2,427,073 | A | * | 9/1947 | Schweitzer | 277/325 |
| 2,463,755 | A | | 3/1949 | Edwards | |
| 2,542,302 | A | | 2/1951 | Barker | |
| 2,660,248 | A | | 11/1953 | Brown | |
| 2,746,710 | A | | 5/1956 | Jones | |
| 2,760,749 | A | * | 8/1956 | Ratigan | 251/1.3 |
| 2,919,111 | A | | 12/1959 | Nicolson | |
| 2,960,357 | A | | 11/1960 | Scaramucci | |
| 3,102,709 | A | * | 9/1963 | Allen | 251/1.3 |
| 3,399,901 | A | | 9/1968 | Crow et al. | |
| 3,416,767 | A | * | 12/1968 | Blagg | 251/1.3 |
| 3,475,798 | A | | 11/1969 | Crickmer | |
| 3,572,628 | A | * | 3/1971 | Jones | 251/1.2 |
| 3,690,381 | A | | 9/1972 | Slator et al. | |
| 3,736,982 | A | | 6/1973 | Vujasinovic | |
| 3,897,039 | A | * | 7/1975 | Le Rouax | 251/1.2 |
| 4,043,389 | A | | 8/1977 | Cobb | |
| 4,057,887 | A | | 11/1977 | Jones et al. | |
| 4,071,085 | A | | 1/1978 | Grable et al. | |
| 4,133,342 | A | * | 1/1979 | Carnahan | 166/277 |
| 4,216,848 | A | | 8/1980 | Shimodaira | |
| 4,265,424 | A | | 5/1981 | Jones | |
| 4,323,256 | A | | 4/1982 | Miyagishima et al. | |
| 4,550,895 | A | | 11/1985 | Shaffer | |
| 4,576,067 | A | | 3/1986 | Buck | |
| 4,583,569 | A | | 4/1986 | Ahlstone | |
| 4,647,002 | A | | 3/1987 | Crutchfield | |
| 4,699,350 | A | * | 10/1987 | Herve | |
| 4,825,948 | A | | 5/1989 | Carnahan | |
| 4,844,406 | A | | 7/1989 | Wilson | |
| 4,860,826 | A | * | 8/1989 | Land | |
| 4,898,238 | A | | 2/1990 | Grantom | |
| 4,919,459 | A | | 4/1990 | Miller | |
| 4,938,290 | A | | 7/1990 | Leggett et al. | |
| 4,993,276 | A | | 2/1991 | Edwards | |
| 5,009,289 | A | | 4/1991 | Nance | |
| 5,013,005 | A | | 5/1991 | Nance | |
| 5,090,529 | A | | 2/1992 | Fahy et al. | |
| 5,291,808 | A | | 3/1994 | Buck | |
| 5,309,990 | A | | 5/1994 | Lance | |
| 5,327,961 | A | | 7/1994 | Mills | |
| 5,346,004 | A | * | 9/1994 | Borden et al. | 166/86.1 |
| 5,358,036 | A | | 10/1994 | Mills | |
| 5,435,385 | A | | 7/1995 | Wilson | |
| 5,551,510 | A | | 9/1996 | Mills | |
| 5,575,451 | A | | 11/1996 | Colvin et al. | |
| 5,590,867 | A | | 1/1997 | Van Winkle | |
| 5,667,369 | A | | 9/1997 | Cholet | |
| 5,725,193 | A | | 3/1998 | Adams | |
| 5,743,332 | A | | 4/1998 | Lam et al. | |
| 5,746,249 | A | * | 5/1998 | Wright et al. | 137/614.19 |
| 5,765,813 | A | | 6/1998 | Lam et al. | |
| 5,823,541 | A | | 10/1998 | Dietle et al. | |
| 5,875,841 | A | * | 3/1999 | Wright et al. | 166/85.4 |
| 6,012,528 | A | | 1/2000 | Van Winkle | |
| 6,024,172 | A | * | 2/2000 | Lee | 166/84.4 |
| 6,039,115 | A | | 3/2000 | Mills | |
| 6,079,489 | A | | 6/2000 | Hult et al. | |
| 6,109,348 | A | | 8/2000 | Caraway | |
| 6,113,355 | A | | 9/2000 | Hult et al. | |
| 6,125,931 | A | | 10/2000 | Hult et al. | |
| 6,176,466 | B1 | * | 1/2001 | Lam et al. | |
| 6,189,609 | B1 | | 2/2001 | Shaaban et al. | |
| 6,223,819 | B1 | | 5/2001 | Heinonen | |
| 6,260,817 | B1 | * | 7/2001 | Lam et al. | |
| 6,378,399 | B1 | | 4/2002 | Bangert | |
| 6,557,639 | B1 | | 5/2003 | Matthews et al. | |
| 6,588,510 | B2 | * | 7/2003 | Card et al. | 166/85.1 |
| 6,843,313 | B2 | * | 1/2005 | Hult | 166/84.4 |

FOREIGN PATENT DOCUMENTS

| | | | | |
|---|---|---|---|---|
| CA | 1305048 | C | | 7/1992 |
| CA | 2266367 | A1 | | 3/1998 |
| CA | 2216456 | | | 3/1999 |
| CA | 2349988 | A1 | | 10/2001 |
| CA | 2311036 | A1 | * | 12/2001 |
| CA | 2716430 | A1 | | 12/2001 |
| CA | 2218202 | | | 5/2002 |
| EP | 528638 | A1 | | 2/1993 |

OTHER PUBLICATIONS

Excerpt from 1957 Composite Catalogue of Oil Field Equipment and Services for Rector Well Equipment Co., Inc. Type "CRS" Rectorhead Round Ram Tubing Head [Dated: 1957].

Excerpt from Parker Seal Company O-Ring Handbook [Dated: 1971].

Engineering Materials: Properties and Selection [Dated: 1979].

Excerpt from Bowen Tools, Inc. General Catalog [Dated:1978-1979].

Bundle of excerpts from 1982-1983 Composite Catalogue of Oil Field Equipment and Services [Dated: 1982-1983].

Product specification sheet for Industrial Export Import Blowout Preventor Equipment [Dated: 1982-1983].

Excerpts from 1982-1983 Composite Catalogue of Oil Field Equipment and Services [Dated: 1982-1983].

Extracts from Kalpakjian Manufacturing Processes for Engineering Materials [Dated: 1985].

Excerpt from 1988-1989 Composite Catalogue of Oil Field Equipment and Services relating to Texas Oil Tools Products [Dated: 1988-1989].

Double-E Inc. drawing C12LP2 and Double-E Inc. Blowout Preventer Maintenance Instruction Sheet [Dated: Feb. 9, 1988].

Smith "Methods of Determining the Operational Life of Individual Strings of Coiled Tubing" [Dated: 1989].

Huber-Hercules General Product Catalogue [Dated: 1989].

Excerpt from 1990-1991 Composite Catalogue of Oilfield Equipment and Services, comprising title page of vol. 1 and pp. 1151-1158 [Dated: 1990-1991].

Excerpt from 1992-1993 Composite Catalogue of Oilfield Equipment and Services, comprising title page of vol. 1 and pp. 1029-1040 [Dated: 1992-1993].

Texas Oil Tools—Brochure [Dated: May 1993].

Extracts from Dudley Handbook of Practical Gear Design [Dated: 1994].

Double-E, Inc. drawing entitled "BOP, Coiled Tubing" [Dated: Nov. 3, 1994].

Bundle of Materials regarding Double-E Inc. Gripping Rams [Dated: Nov. 1994].

Double-E, Inc. drawing entitled SL P RAM, BOP, Coiled Tubing [Dated: Nov. 8, 1994].

Excerpt from 1994-1995 Composite Catalogue of Oil Field Equipment and Services, comprising title page of vol. 1 and pp. 905-907 [Dated: 1994-1995].

Larry Angelo, R & M Energy Systems, "Effects of Polished Rod Clamps on Polished Rod Fatigue Lift" [Dated: Jan. 1995].

Texas Oil Tools' Brochure; 3.01 10M COMBI [Dated: Jun. 1996].

Excerpt from 1996-1997 Cameron Catalogue [Dated: 1996-1997].

Excerpt from 1996-1997 Composite Catalogue of Oil Field Equipment and Services, comprising title page of vol. 1 and pp. 921-923 [Dated: 1996-1997].

Double-E, Inc. Brochure [Dated: 1997].

Texas Oil Tools (Spec No. ATEH-4000) [Dated: May 8, 1998].

(56) References Cited

OTHER PUBLICATIONS

Excerpt from 1998-1999 Composite Catalogue of Oil Field Equipment and Services, comprising title page of vol. 2 and p. 1765 [Dated: 1998-1999].
Brochure of Texas Oil Tools [Dated: Apr. 1999].
Steamflow Brochure (publicly available prior to Oct. 7, 2004).
R & M Energy Systems brochure re polished rod clamps (publicly available prior to Oct. 7, 2004).
Photographs Huber Hinged Clamp (publicly available prior to Oct. 7, 2004).
Double E LP 15 sheet (publicly available prior to Oct. 7, 2004).
Canadian Reissue Patent CA2349988 published May 12, 2005.
Domino Machine Co. Ltd., Integral B.O.P. Ram, dated Nov. 1995, and Photograph.
*Oil Lift Technology Inc.* vs *Domino Machine Inc.*, Amended Reply and Defence to Counterclaims dated Jan. 20, 2014.
*Oil Lift Technology Inc.* vs *Domino Machine Inc.*, Amended Statement of Defence and Counterclaim dated Dec. 2, 2013.
*Oil Lift Technology Inc.* vs *Domino Machine Inc.*, Reply and Defence to Counterclaim dated Jul. 15, 2013.
*Oil Lift Technology Inc.* vs *Domino Machine Inc.*, Statement of Claim dated Apr. 30, 2013.
*Oil Lift Technology Inc.* vs *Domino Machine Inc.*, Statement of Defence and Counterclaim dated Jun. 14, 2013.
*Oil Lift Technology Inc.* vs *Grenco Industries Ltd.*, Amended Statement of Defence and Counterclaim dated Jun. 2, 2004.
*Oil Lift Technology Inc.* vs *Grenco Industries Ltd.*, Notice of Discontinuance filed Sep. 2, 2005.
*Oil Lift Technology Inc.* vs *Grenco Industries Ltd.*, Particulars to Amended Statement of Defence and Counterclaim dated Jun. 4, 2004.
*Oil Lift Technology Inc.* vs *Grenco Industries Ltd.*, Reply and Defence to Counterclaim dated Oct. 9, 2002.
*Oil Lift Technology Inc.* vs *Grenco Industries Ltd.*, Statement of Claim dated Jul. 24, 2002.
*Oil Lift Technology Inc.* vs *Grenco Industries Ltd.*, Statement of Defence and Counterclaim dated Sep. 9, 2002.
*Oil Lift Technology Inc.* vs *Millennium Oilflow Systems & Technology Inc.* dba Most Oil Corporation, Reply and Defence to Counterclaim dated Apr. 7, 2014.
*Oil Lift Technology Inc.* vs *Millennium Oilflow Systems & Technology Inc.* dba Most Oil Corporation, Statement of Claim dated Jan. 17, 2014.
*Oil Lift Technology Inc.* vs *Millennium Oilflow Systems & Technology Inc.* dba Most Oil Corporation, Statement of Defence and Counterclaim dated Mar. 7, 2014.
*Oil Lift Technology Inc.* vs *Seaboard Canada Ltd.* c.o.b. as AJ Industries Ltd. and AJ Energy Services, Statement of Claim dated Apr. 30, 2013.
*Oil Lift Technology Inc.* vs *Torque Control Systems Ltd.*, Amended Reply and Defence to Counterclaim dated Sep. 19, 2005.
*Oil Lift Technology Inc.* vs *Torque Control Systems Ltd.*, Amended Statement of Claim dated Sep. 20, 2005.
*Oil Lift Technology Inc.* vs *Torque Control Systems Ltd.*, Amended Statement of Defence and Counterclaim dated Sep. 14, 2005.
*Oil Lift Technology Inc.* vs *Torque Control Systems Ltd.*, Four Times Amended Statement of Defence and Counterclaim dated Jul. 29, 2010.
*Oil Lift Technology Inc.* vs *Torque Control Systems Ltd.*, Judgment dated Sep. 30, 2010.
*Oil Lift Technology Inc.* vs *Torque Control Systems Ltd.*, Reply and Defence to Counterclaim dated Apr. 6, 2004.
*Oil Lift Technology Inc.* vs *Torque Control Systems Ltd.*, Statement of Claim dated Jan. 20, 2004.
*Oil Lift Technology Inc.* vs *Torque Control Systems Ltd.*, Statement of Defence and Counterclaim dated Mar. 15, 2004.
*Oil Lift Technology Inc.* vs *Torque Control Systems Ltd.*, Three Times Amended Reply and Defence to Counterclaim dated Feb. 18, 2010.
*Oil Lift Technology Inc.* vs *Torque Control Systems Ltd.*, Three Times Amended Statement of Defence and Counterclaim dated Jan. 18, 2010.
*Oil Lift Technology Inc.* vs *Torque Control Systems Ltd.*, Twice Amended Reply and Defence to Counterclaim dated Apr. 22, 2008.
*Oil Lift Technology Inc.* vs *Torque Control Systems Ltd.*, Twice Amended Statement of Claim dated Mar. 27, 2008.
*Oil Lift Technology Inc.* vs *Torque Control Systems Ltd.*, Twice Amended Statement of Defence and Counterclaim dated Apr. 11, 2008.
PC Pump Installations, 2 figures (prior art publicly available prior to Jun. 9, 2000).
Maintenance Photographs (prior art publicly available prior to Jun. 9, 2000).
BOP Ram Photographs (prior art publicly available prior to Jun. 9, 2000).

* cited by examiner

POLISH ROD LOCKING CLAMP

CROSS-REFERENCE TO RELATED APPLICATIONS

The present application is a divisional of U.S. patent application Ser. No. 09/878,465, filed on Jun. 11, 2001, now U.S. Pat. No. 6,843,313, issued Jan. 18, 2005, which claims priority from Canadian Patent Application No. 2,311,036, filed Jun. 9, 2000.

FIELD OF THE INVENTION

The present invention relates generally to progressing cavity pump oil well installations and, more specifically, to a drive head for use in progressing cavity pump oil well installations.

BACKGROUND OF THE INVENTION

Progressing cavity pump drives presently on the market have weaknesses with respect to the stuffing box, backspin retarder and the power transmission system. Oil producing companies need a pump drive which requires little or no maintenance, is very safe for operating personnel and minimizes the chances of product leakage and resultant environmental damage. When maintenance is required on the pump drive, it must be safe and very fast and easy to do.

Due the abrasive sand particles present in crude oil and poor alignment between the wellhead and stuffing box, leakage of crude oil from the stuffing box is common in some applications. This costs oil companies money in service time, down time and environmental clean up. It is especially a problem in heavy crude oil wells in which the oil is often produced from semi-consolidated sand formations since loose sand is readily transported to the stuffing box by the viscosity of the crude oil. Costs associated with stuffing box failures are one of the highest maintenance costs on many wells.

Servicing of stuffing boxes is time consuming and difficult. Existing stuffing boxes are mounted below the drive head. Stuffing boxes are typically separate from the drive and are mounted in a wellhead frame such that they can be serviced from below the drive head without removing it. This necessitates mounting the drive head higher, constrains the design and still means a difficult service job. Drive heads with integral stuffing boxes mounted on the bottom of the drive head have more recently entered the market. In order to service the stuffing box, the drive must be removed which necessitates using a rig with two winch lines, one to support the drive and the other to hold the polished rod. This is more expensive and makes servicing the stuffing box even more difficult. As a result, these stuffing boxes are typically exchanged in the field and the original stuffing box is sent back to a service shop for repair-still unsatisfactory.

Due to the energy stored in wind up of the sucker rods used to drive the progressing cavity pump and the fluid column on the pump, each time a well shuts down a backspin retarder brake is required to slow the backspin shaft speed to a safe level and dissipate the energy. Because sheaves and belts are used to transmit power from the electric motor to the pump drive head on all existing equipment in the field, there is always the potential for the brake to fail and the sheaves to spin out of control. If sheaves turn fast enough, they will explode due to tensile stresses which result due to centrifugal forces. Exploding sheaves are very dangerous to operating personnel.

SUMMARY OF THE INVENTION

The present invention seeks to address all these issues and combines all functions into a single drive head. The drive head of the present invention eliminates the conventional belts and sheaves that are used on all drives presently on the market, thus eliminating belt tensioning and replacement. Elimination of belts and sheaves removes a significant safety hazard that arises due to the release of energy stored in wind up of rods and the fluid column above the pump.

One aspect of the invention relates to a centrifugal backspin retarder, which controls backspin speed and is located on a drive head input shaft so that it is considerably more effective than a retarder located on the output shaft due to its mechanical advantage and the higher centrifugal forces resulting from higher speeds acting on the centrifugal brake shoes. A ball-type clutch mechanism is employed so that brake components are only driven when the drive is turning in the backspin direction, thus reducing heat buildup due to viscous drag.

Another aspect of the present invention relates to the provision of an integrated rotating stuffing box mounted on the top side of the drive head, which is made possible by a unique standpipe arrangement. This makes the stuffing box easier to service and allows a pressurization system to be used such that any leakage past the rotating seals or the standpipe seals goes down the well bore rather than spilling onto the ground or into a catch tray and then onto the ground when that overflows.

In the present invention, only one winch line is required to support the polish rod because the drive does not have to be removed to service the stuffing box. In order to eliminate the need for a rig entirely, a still further aspect of the present invention provides a special clamp integrated with the drive head to support the polished rod and prevent rotation while the stuffing box is serviced. Preferably, blow out preventers are integrated into the clamping means and are therefore closed while the stuffing box is serviced, thus preventing any well fluids from escaping while the stuffing box is open.

According to the present invention then, there is provided a drive head assembly for use to fluid sealingly rotate a rod extending down a well, comprising a rotatable sleeve adapted to concentrically receive a portion of said rod therethrough; means for drivingly connecting said sleeve to the rod; and a prime mover drivingly connected to said sleeve for rotation thereof.

According to another aspect of the present invention then, there is also provided in a stuffing box for sealing the end of a rotatable rod extending from a well bore, the improvement comprising a first fluid passageway disposed concentrically around at least a portion of the rod passing through the stuffing box; a second fluid passageway disposed concentrically inside said first passageway, said second passageway being in fluid communication with wellhead pressure during normal operations; said first and second passageways being in fluid communication with one another and having seal means disposed therebetween to permit the maintenance of a pressure differential between them; and means to pressurize fluid in said first passageway to a pressure in excess of wellhead pressure to prevent the leakage of well fluids through the stuffing box.

According to another aspect of the present invention then, there is also provided a drive head for use with a progressing cavity pump in an oil well, comprising a drive head housing; a drive shaft rotatably mounted in said housing for connection to a drive motor; an annular tubular sleeve rotatably mounted in said housing and drivingly connected to said drive shaft; a tubular standpipe concentrically mounted within said sleeve in annularly spaced relation thereto defining a first tubular fluid passageway for receiving fluid at a first pressure and operable to receive a polished rod therein in annularly spaced relation defining a second tubular fluid passageway exposed to oil well pressure during normal operation; seal means disposed in said first fluid passageway; means for maintaining the fluid pressure within said first fluid passageway greater than the fluid pressure in said second fluid passageway; and means for releasably drivingly connecting said sleeve to a polished rod mounted in said standpipe.

According to another aspect of the present invention them, there is also provided in a drive head for rotating a rod extending down a well, the drive head having an upper end and a lower end, the improvement comprising a stuffing box for said rod integrated into the upper end of said drive head to enable said stuffing box to be serviced without removing said drive head from the well.

BRIEF DESCRIPTION OF THE DRAWINGS

These and other features of preferred embodiments of the present invention will become more apparent from the following description in which reference is made to the appended drawings in which.

DETAILED DESCRIPTION OF PREFERRED EMBODIMENTS OF THE INVENTION

Figure 1:
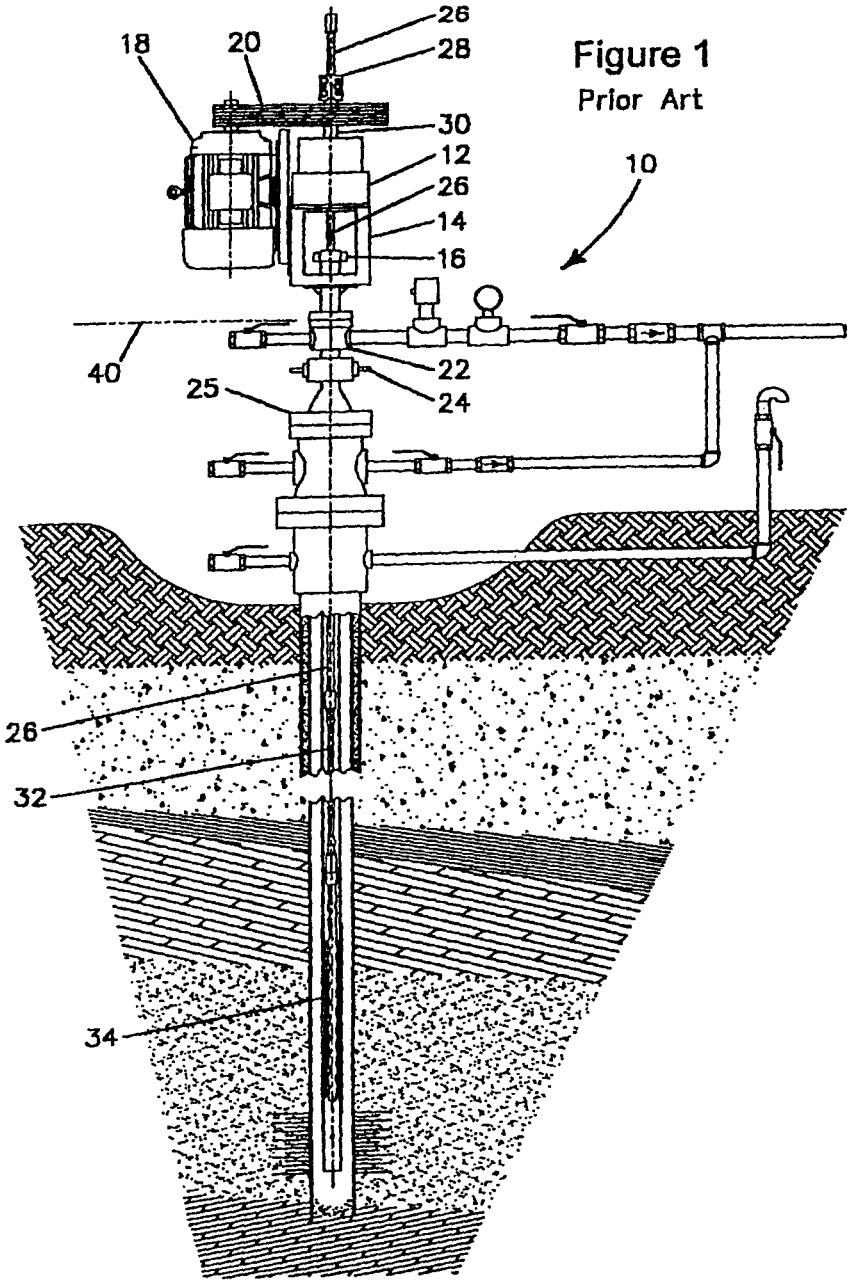
Figure 1 Prior Art
FIG. 1 is a view of a progressing cavity pump oil well installation in an earth formation with a typical drive head, wellhead frame and stuffing box.

FIG. 1 illustrates a known progressing cavity pump installation 10. The installation includes a typical progressing cavity pump drive head 12, a wellhead frame 14, a stuffing box 16, an electric motor 18, and a belt and sheave drive system 20, all mounted on a flow tee 22. The flow tee is shown with a blow out preventer 24 which is, in turn, mounted on a wellhead 25. The drive head supports and drives a drive shaft 26, generally known as a "polished rod". The polished rod is supported and rotated by means of a polish rod clamp 28, which engages an output shaft 30 of the drive head by means of milled slots (not shown) in both parts. Wellhead frame 14 is open sided in order to expose polished rod 26 to allow a service crew to install a safety clamp on the polished rod and then perform maintenance work on stuffing box 16. Polished rod 26 rotationally drives a drive string 32, sometimes referred to as "sucker rods", which, in turn, drives a progressing cavity pump 34 located at the bottom of the installation to produce well fluids to the surface through the wellhead.

Figure 2:
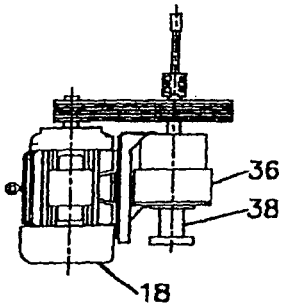
Figure 2 Prior Art
FIG. 2 is a view similar to the upper end of FIG. 1 but illustrating a conventional drive head with an integrated stuffing box extending from the bottom end of the drive head.

FIG. 2 illustrates a typical progressing cavity pump drive head 36 with an integral stuffing box 38 mounted on the bottom of the drive head and corresponding to that portion of the installation in FIG. 1 which is above the dotted and dashed line 40. The main advantage of this type of drive head is that, since the main drive head shaft is already supported with bearings, stuffing box seals can be placed around the main shaft, thus improving alignment and eliminating contact between the stuffing box rotary seals and the polished rod. This style of drive head reduces the height of the installation because there is no wellhead frame and also reduces cost because there is no wellhead frame and there are fewer parts since the stuffing box is integrated with the drive head. The main disadvantage is that the drive head must be removed to do maintenance work on the stuffing box. This necessitates using a service rig with two lifting lines, one to support the polished rod and the other to support the drive head.

The drive head of the present invention is arranged to be connected directly to and between an electric or hydraulic drive motor and a conventional flow tee of an oil well installation to house drive means for rotatably driving a conventional polished rod, and for not only providing the function of a stuffing box, but one which can be accessed from the top of the drive head to facilitate servicing of the drive head and stuffing box components.

Another preferred aspect of the present invention is the provision of a polished rod lock-out clamp for use in clamping the polished rod during drive head servicing operations. The clamp can be integrated with the drive head or provided as a separate assembly below the drive head. Finally, the drive head may be provided with a backspin retarder to control backspin of the pump drive string following drive shut down.

Figure 3:
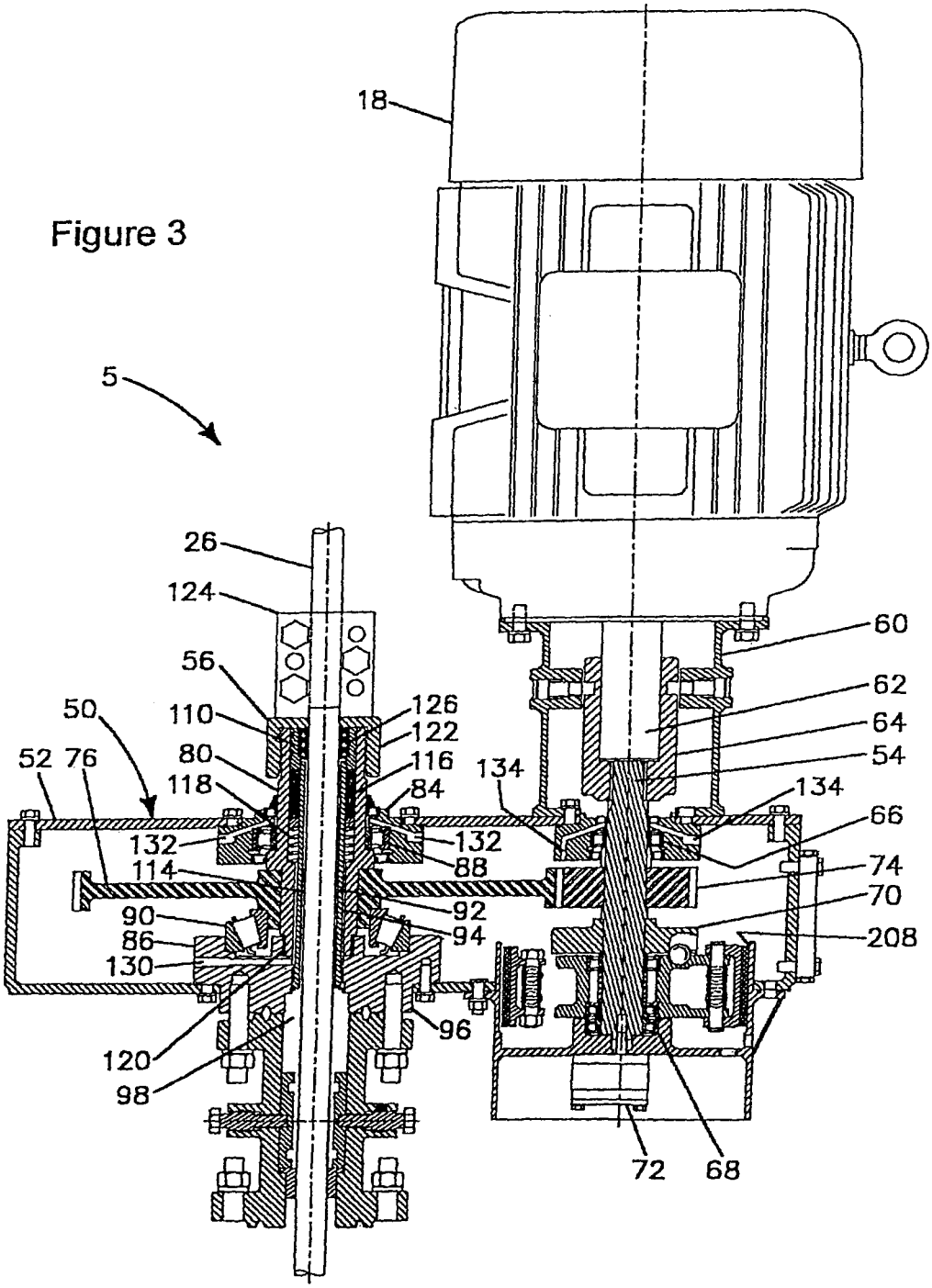
FIG. 3 is a cross-sectional view according to a preferred embodiment of the present invention.
Figures 4, 5:
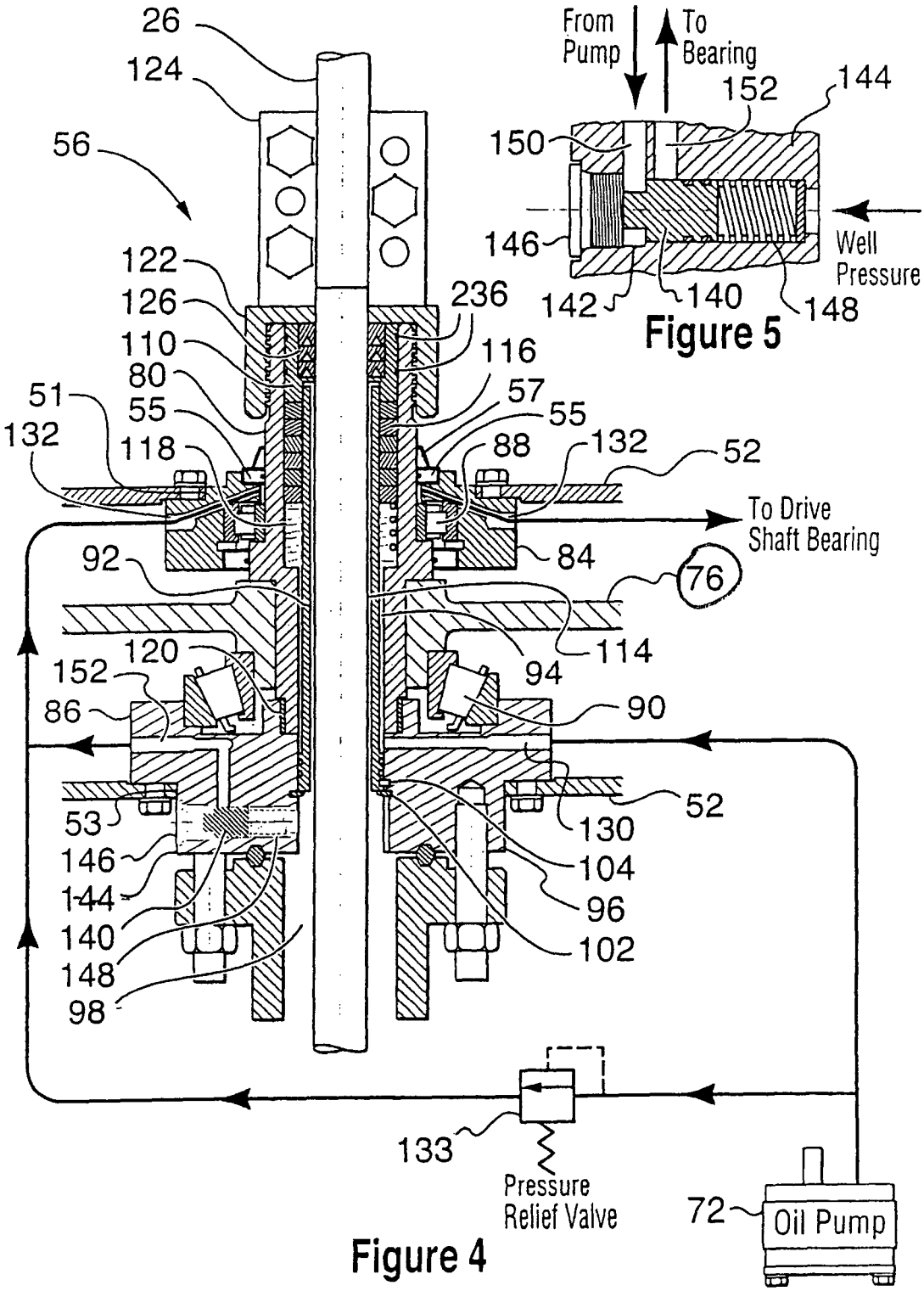
FIG. 4 is an enlarged, partially broken cross-sectional view of the drive head of FIG. 3 including the main shaft and stuffing box thereof modified to include an additional pressure control system.
FIG. 5 is an enlarged cross-sectional view of the pressure control system shown in FIG. 4.

Referring to FIGS. 3 and 4, the drive head assembly according to a preferred embodiment of the present invention is generally designated by reference numeral 5 and comprises a drive head 50 and a prime mover such as electric motor 18 to actuate drive head 50 and rotate polished rod 26 as will be described below. The drive head assembly includes a housing 52 in which is mounted an input or drive shaft 54 connected to motor 18 for rotation and, as part of the drive head 50, an output shaft assembly 56 drivingly connected to a conventional polished rod 26. Drive shaft 54 is connected directly to electric drive motor 18, eliminating the conventional drive belts and sheaves and the disadvantages associated therewith. Output shaft assembly 56 provides a fluid seal between the fluid in drive head 50 and formation fluid in the well. The fluid pressure on the drive head side of the seal is above the wellhead pressure. The fluid seal provides the functions of a conventional stuffing box and, accordingly, not only eliminates the need for a separate stuffing box, which further reduces the height of the assembly above the flow tee, but is easily serviceable from the top of the drive head, as will be explained.

Electric motor 18 is secured to housing 52 by way of a motor mount housing 60 which encloses the motor's drive shaft 62 which in turn is drivingly connected to drive shaft 54 by a releasable coupling 64 known in the art. Drive shaft 54 is rotatably mounted in upper and lower shaft bearing assemblies 66 and 68, respectively, which are secured to housing 52. The lower end of drive shaft 54 is advantageously coupled to a centrifugal backspin retarder 70 and to an oil pump 72. A drive gear 74 is mounted on drive shaft 54 and meshes with a driven gear 76.

Driven gear 76 is drivingly connected to and mounted on a tubular sleeve 80 which is part of tubular output shaft assembly 56. Depending on the viscosity or weight of the fluids being produced from the well, the ratios between the drive and driven gears can be changed for improved operation. Part of assembly 56 functions as a rotating stuffing box as will now be described.

Sleeve 80 is mounted for rotation in upper and lower bearing cap assemblies 84 and 86, respectively, secured to housing 52 as seen most clearly in FIG. 4.

Upper bearing cap assembly 84 is located in opening 51 formed in housing 52's upper surface, and lower bearing cap assembly 86 is situated in vertically aligned opening 53 formed in the housing's lower surface. The upper end of sleeve 80 extends through upper cap 84 so that the top of shaft assembly 56 is easily accessible from outside the housing's upper surface for service access without having to remove the drive head from the well. Where sleeve 80 exits bearing cap 84, sealing is provided by any suitable means such as an oil seal 55 and a rubber flinger ring 57.

Upper bearing cap assembly 84 houses a roller bearing 88 and lower bearing cap 86 houses a thrust roller bearing 90 which vertically supports and locates sleeve 80 and driven gear 76 in the housing.

A standpipe 92 is concentrically mounted within the inner bore of sleeve 80 in spaced apart relation to define a first axially extending outer annular fluid passage 94 between the standpipe's outer surface and sleeve 80's inner surface. Standpipe 92 is arranged to concentrically receive polished rod 26 therethrough in annularly spaced relation to define a second inner axially extending annular fluid passage 114 between the standpipe's inner surface and the polished rod's outer surface. Lower bearing cap assembly 86 includes a downwardly depending tubular housing portion 96 with a bore 98 formed axially therethrough which communicates with inner fluid passage 114. The lower end of the standpipe is seated on an annular shoulder defined by a snap ring 102 mounted in a mating groove in inner bore 98 of the lower bearing cap assembly. The standpipe is prevented from rotating by, for example, a pin 104 extending between the lower bearing cap assembly and the standpipe. The upper end of the standpipe is received in a static or ring seal carrier 110 which is mounted in the upper end of sleeve 80.

A plurality of ring seals or packings 116 are provided at the upper end of outer annular fluid passage 94 between a widened portion of the inner bore of sleeve 80 and outer surface of the standpipe 92, and between the underside of seal carrier 110 and a compression spring 118 which biases the packings against seal carrier 110, or at least towards the carrier if by chance wellhead pressure exceeds the force of the spring and the pressure in outer passage 94. A bushing or labyrinth seal 120 is provided between the outer surface of the lower end of sleeve 80 and an inner bore of lower bearing cap assembly 86. The upper end of inner fluid passage 114 communicates with the upper surface of packings 116. As will be described below, pressurized fluid in outer fluid passage 94 and spring 118 act on the lower side of the packings, opposing the pressure exerted by the well fluid in passage 114 to prevent leakage.

The upper end of sleeve 80 extending above housing 52 is threadedly coupled to a drive cap 122 which in turn is coupled to a polished rod drive clamp 124 which engages polished rod 26 for rotation. A plurality of static seals 126 are mounted in static seal carrier 110 to seal between the seal carrier and the polished rod. O-rings 236 seal the static seal carrier 110 to the inside of sleeve 80. As there is clearance between the upper end of standpipe 92 and seal carrier 110 for fluid communication between fluid passages 114 and 94, there is some compliancy in the standpipe's vertical orientation which allows it to adapt to less than perfect alignment of the polished rod.

A pressurization system is provided to pressurize outer annular fluid passage 94. To that end, the lower bearing cap assembly includes a diametrically extending oil passage 130. One end of passage 130 in the lower bearing cap is connected to the high pressure side of oil pump 72 by a conduit (not shown) and communicates with the lower end of outer annular passage 94. The high pressure side of the pump is also connected to a pressure relief valve 133 which, if the pressure delivered by the pump reaches a set point, will open to allow oil to flow into passage 132 in the upper bearing cap assembly by a conduit (not shown) to lubricate bearings 88 and oil seal 55. The other end of passage 132 in the upper bearing cap assembly communicates with a similar passage 134 in upper bearing cap 66 supporting drive shaft 54. The fluid pressure supplied to passage 130 from pump 72 is maintained above the pressure at the wellhead. A pressure differential in the order of 50 to 500 psi is believed to be adequate although greater or lesser differentials are contemplated.

An enhancement to automatically adjust stuffing box pressure in relation to wellhead pressure is illustrated in FIGS. 4 and 5. A valve spool or piston 140 is mounted in a port 142 formed in the wall 144 of lower tubular portion 96 of lower bearing cap assembly 86. An access cap 146 is threaded into the outer end of the port. A spring 148 normally biases spool 140 radially outwardly. As best shown in FIG. 5, an axial fluid passage 150 communicates pump pressure to the left side of valve spool 140. A second passage 152 connects to upper bearing cap 84. The inner end of valve spool 140 communicates with wellhead pressure in bore 98. The outer end of the spool communicates with pump pressure against the action of the spring and the wellhead pressure. The spool valve serves to maintain the fluid pressure applied to the first annular passage 94 greater than the well pressure in the second annular passage 114.

In operation, when electric motor 18 is powered, the motor drives shaft 54 which, in turn, rotates drive gear 74 and driven gear 76. Driven gear rotates sleeve 80 and drive cap 122 to rotate polished rod 26 via rod clamp 124. Drive shaft 54 also operates oil pump 72 which applies fluid to outer fluid passage 94 at a pressure which is greater than the wellhead pressure in inner fluid passage 114. This higher pressure is intended to prevent oil well fluids from leaking through the stuffing box and entering into drive head housing 52. The pressure applied to outer annular passage 94 can be set by adjusting pressure relief valve 133 or in the enhanced embodiment of FIG. 4, the spool valve automatically adjusts the pressure applied to outer fluid passage 94 in response to wellhead pressure. Excess flow which is not required to the stuffing box can be released to the top bearings or gear mesh for lubrication. Sleeve 80, packings 116, spring 118, static seals 126 and seal carrier 110 all rotate or are adapted to rotate relative to standpipe 92.

Figure 6:
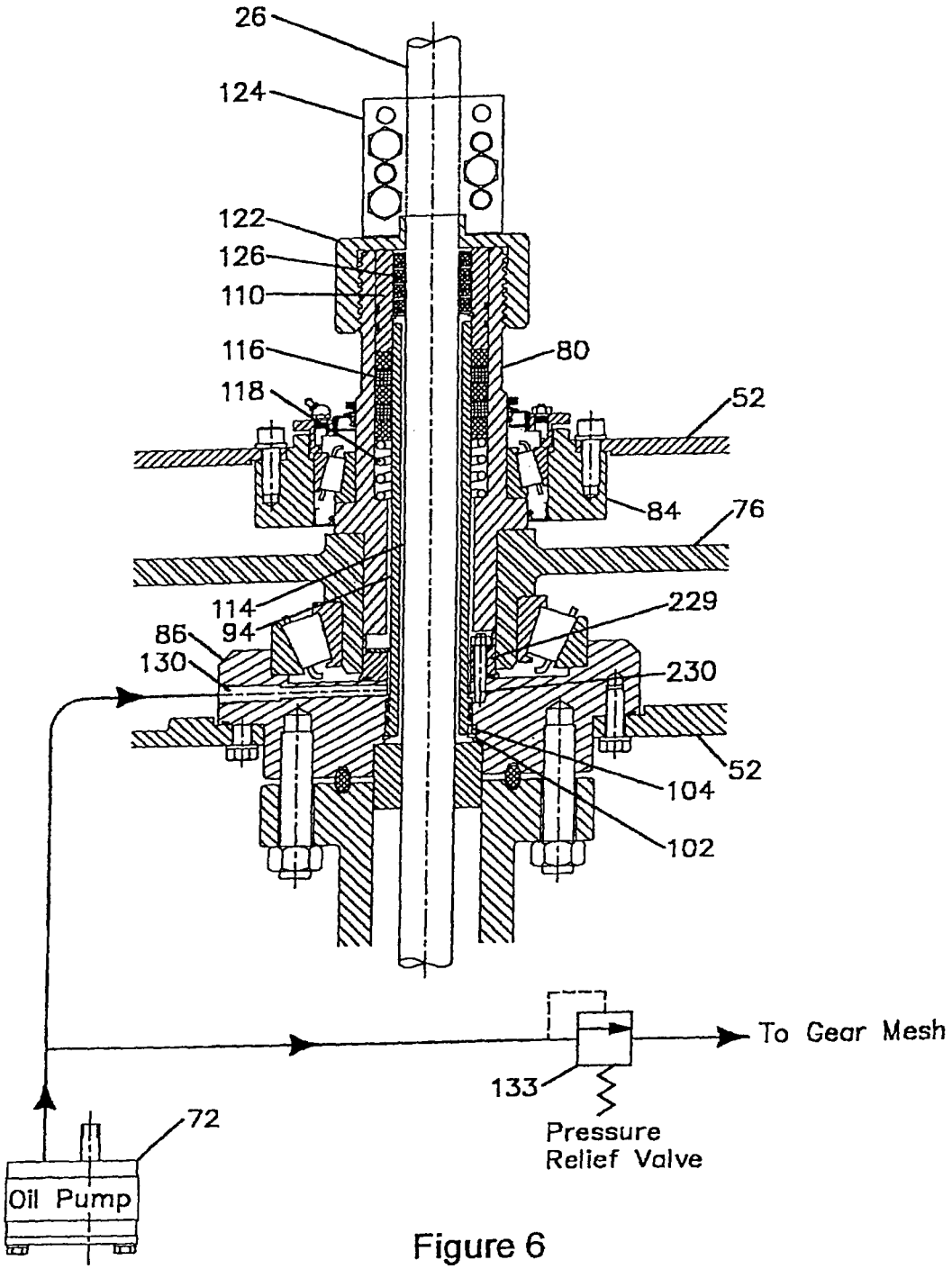
FIG. 6 is a cross-sectional view of another preferred embodiment of the drive head including a floating labyrinth seal.
Figure 7:
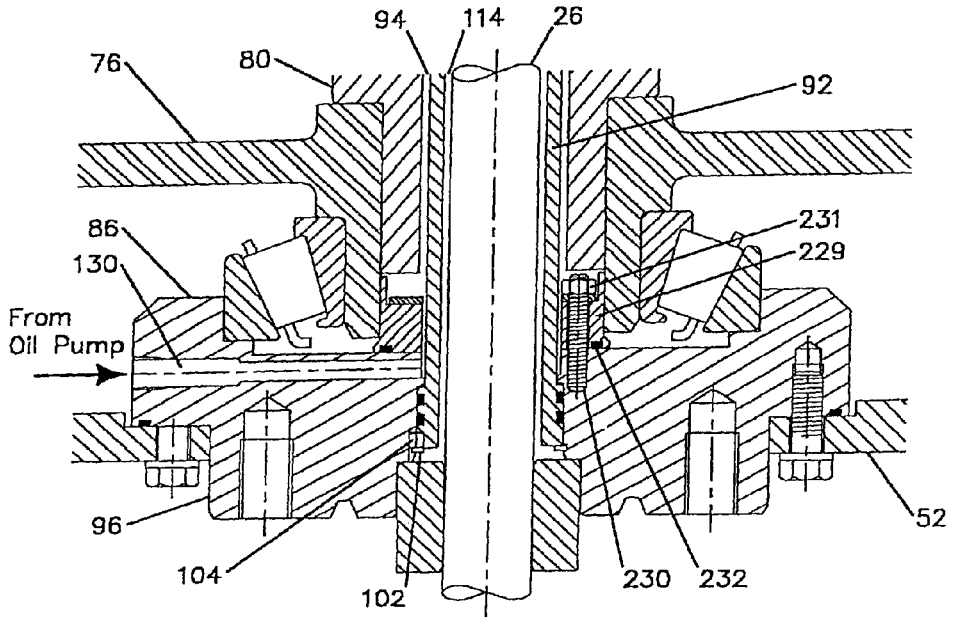
FIG. 7 is an enlarged cross sectional view of the floating labyrinth seal shown in FIG. 6.
Figure 9:
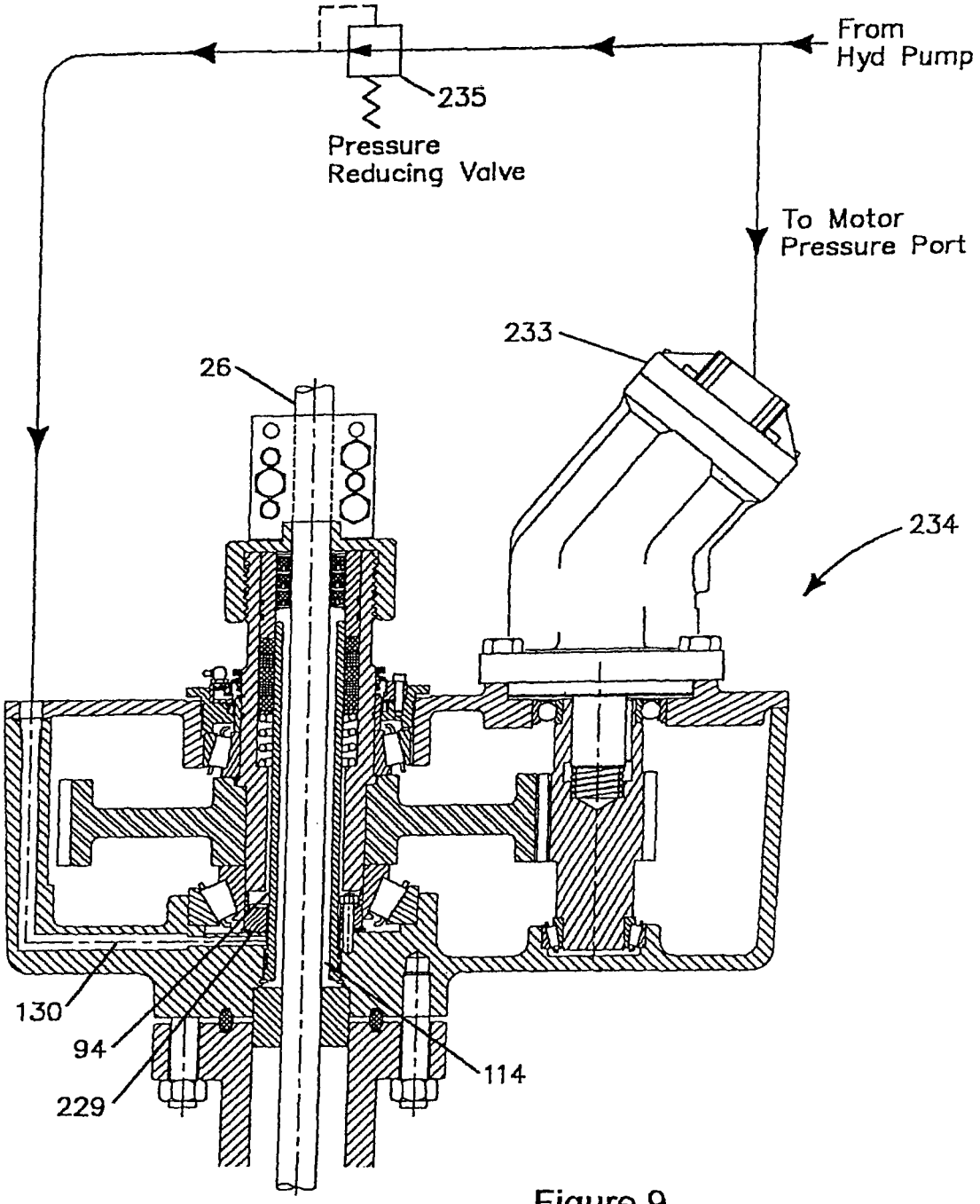
FIG. 9 is a cross sectional view of another embodiment of the drive head with a hydraulic motor and another embodiment of the floating labyrinth seal.
Figure 10:
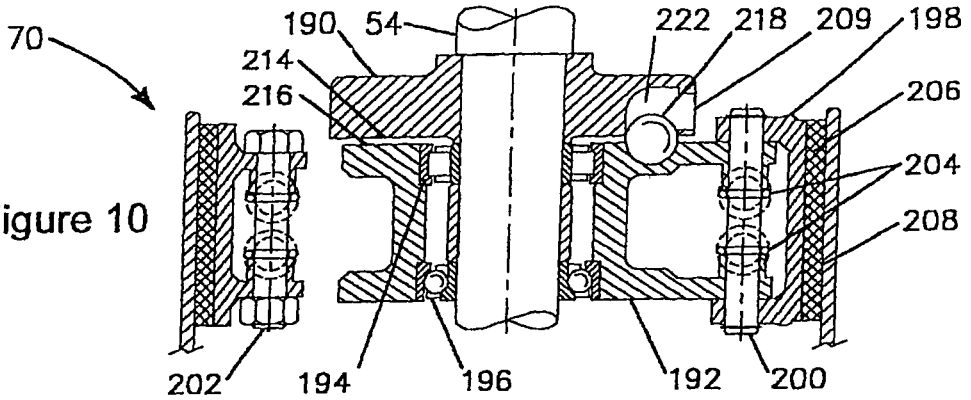
FIG. 10 is a side elevational cross-sectional view of a centrifugal backspin retarder according to a preferred embodiment of the present invention.
Figure 11:
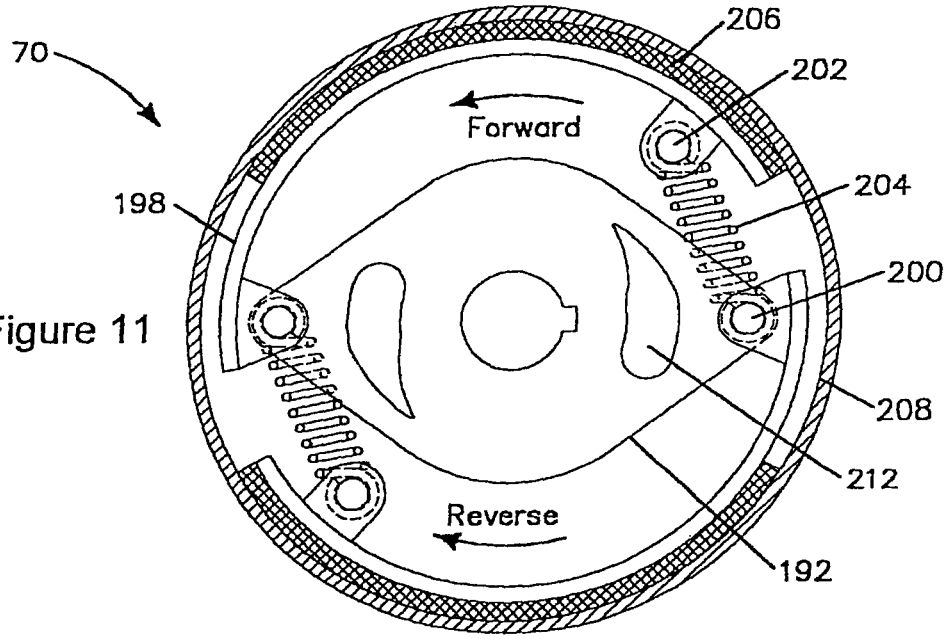
FIG. 11 is a plan view of the centrifugal backspin retarder shown in FIG. 10.

The labyrinth seal 120 between sleeve 80 and the main bearing cap 86 as shown in FIG. 3 is used in the present invention so that there is no contact and thus no wear between these parts in normal operation. However, it is difficult to manufacture a close fitting labyrinth due to run out which is common in all manufactured parts. Due to the difficulty of manufacture, a preferred embodiment of the labyrinth seal is a floating seal 229 which is compliantly mounted to main bearing cap 86 by studs 230 and locknuts 231 as shown in FIG. 6 and in greater detail in FIG. 7. In this embodiment, sleeve 80 is shortened to provide clearance for the seal. Labyrinth seal 229 has clearance holes to receive studs 230 to allow movement of the seal in the horizontal plane. Lock nuts 231 are adjusted to provide a sliding clearance between seal 229 and the top surface of bottom bearing cap 86. An O-ring 232 prevents the flow of oil between the labyrinth seal and the bottom bearing cap. The O-ring preferably has a diameter nearly equal to that of the labyrinth seal since this balances the hydraulic load on the labyrinth seal, reduces force on the lock nuts and allows the labyrinth seal to move and align itself more easily within rotating driven gear 76. Due to typical diametral clearances of 0.002 to 0.005 inches between the stationary labyrinth seal and the rotating driven gear, leakage occurs. Due to hydrodynamic forces generated within the leaked oil by the rotation of the rotating member, similar to the principle of a journal bearing, the labyrinth seal tends to align itself in the center of the rotating component. The rotating component can be the driven gear as shown in FIG. 6, the main bearing inner race as shown in FIG. 9, sleeve 80 or a bushing fixed to the sleeve.

Figure 8:
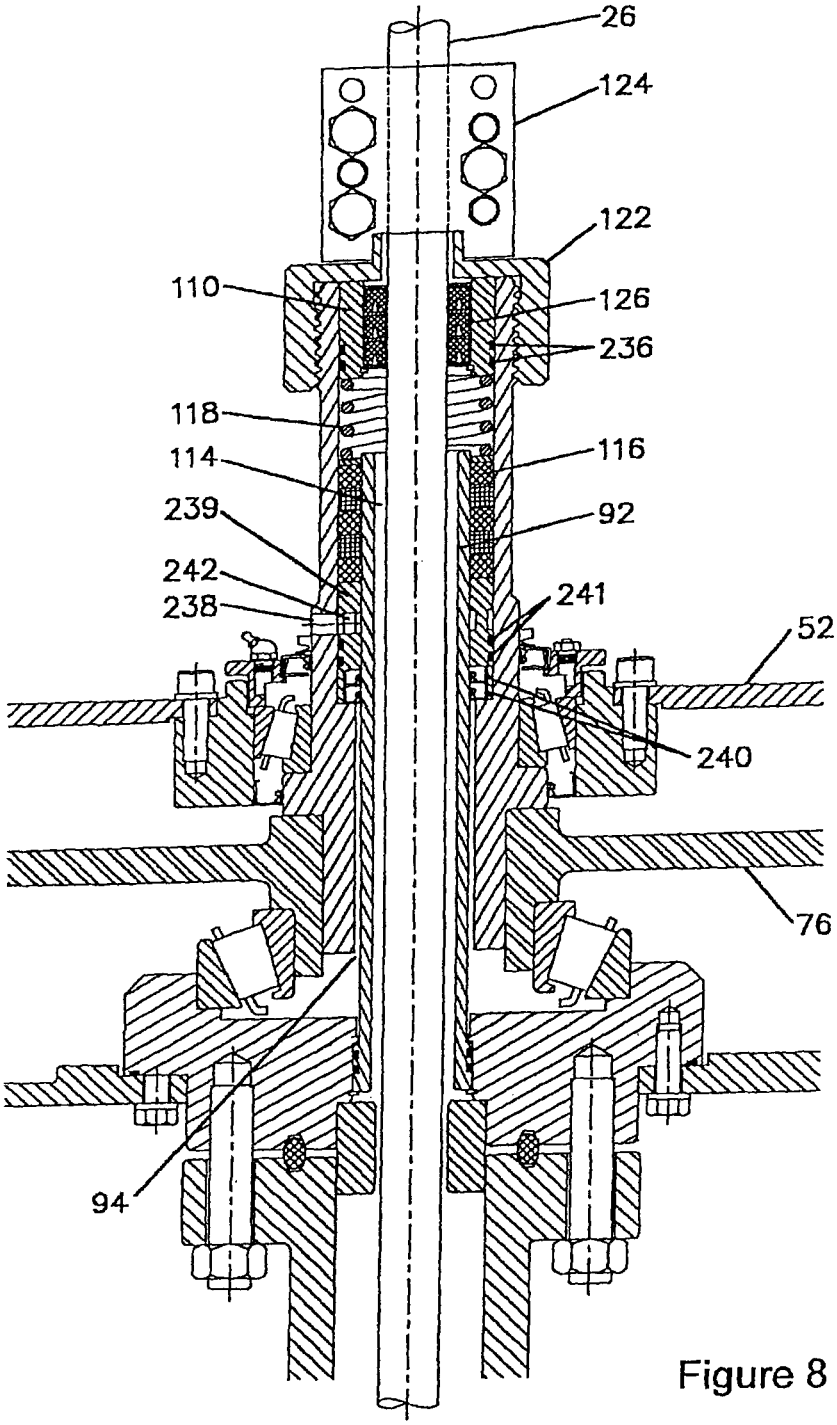
FIG. 8 is a cross sectional view of another embodiment of the drive head including a top mounted stuffing box which is not pressurized.

In some cases, pressurization of the stuffing box is not worthwhile economically but having the stuffing box mounted on the top of the drive head remains a service benefit. FIG. 8 shows a preferred embodiment of a stuffing box which can be serviced from the top of the drive but does not have outer annular passage 94 pressurized. In this embodiment, wellhead pressure is applied to inner annular passage 114. Stuffing box spring 118 is placed between packing rings 116 and static seal carrier 110 to act in the same direction against the seals as wellhead pressure and to eliminate [eliminating] the need for adjustment of the packing rings. Static seals 126 prevent escape of well fluids between polished rod 26 and static seal carrier 110. O-rings 236 prevent escape of well fluids between static seal carrier 110 and the inner bore of sleeve 80. Drive cap 122 is threaded onto sleeve 80 and transmits torque to polished rod clamp 124 to rotate polished rod 26. Leakage past packing rings 116 flows into a lantern ring 239 which has radial holes 242 to communicate with radial holes 238 in sleeve 80 to drain the fluid for collection away from [in] the housing. Leakage of well fluids into the drive head is prevented by static O-rings 241 between the lantern ring and sleeve 80 and by dynamic lip seals 240 between lantern ring 239 and standpipe 92.

In some cases, progressing cavity pump drives use a hydraulic motor rather than an electric motor. Use of hydraulic power provides an opportunity to simplify the drive system and the stuffing box pressurization which will be explained with reference to FIG. 9, showing a preferred embodiment of a drive head driven by a hydraulic motor 233. The drive head assembly 234 shown in this figure with hydraulic drive does not have a backspin retarder braking system since the braking action can be achieved by restricting the flow of hydraulic oil in the backspin direction. Additionally, the pressure from the hydraulic system can be used to pressurize the stuffing box, thus eliminating the need for oil pump 72. Both simplifications affect the drive shaft from the motor since the braking system and the oil pump can be left out of the design thus reducing cost, size and complexity. In hydraulic drive head assembly 234, hydraulic pressure on the input port of hydraulic motor 233 is diverted though a channel (not shown) to a pressure reducing valve 235. The reduced pressure fluid is supplied to oil passage 130 in the lower bearing assembly to pressurize outer fluid passage 94. The pressure reducing valve is set higher than the wellhead pressure in inner fluid passage 114 as in other embodiments.

When it is time to service the part of shaft assembly 56 that functions as the stuffing box, it is merely necessary to remove rod clamp 124 and drive cap 122 to gain access to static seals 126, seal carrier 110, packing rings 116 and spring 118 without having to remove the drive head itself. During servicing, the polished rod can be held in place by a winch line, but as will be described below, the present invention preferably includes its own polished rod clamp which will hold the rod for the length of time required to complete the servicing. When the present unit incorporates its own rod clamp, winch lines can be eliminated altogether for a substantial operational saving.

As mentioned above, backspin from the windup in sucker rods 34 can reach destructive levels. The present drive head assembly can therefore advantageously incorporate a braking assembly to retard backspin, as will now be described in greater detail.

Referring to FIGS. 10-13, a centrifugal brake assembly 70 is comprised of a driving hub 190 and a driven hub 192. Driving hub 190 is connected to the drive shaft 54 for rotation therewith. Driven hub 192 is mounted to freewheel around shaft 54 using an upper roller bearing 194 and a lower thrust bearing assembly 196. One end of each of a pair of brake shoes 198 is pivotally connected to a respective driven hub by a pivot pin 200. A pin 202 on the other end of each of the brake shoes is connected to an adjacent pivot pin 200 on the other respective brake shoe by a helical tension spring 204 so as to bias the brake shoes inwardly toward respective non-braking positions. Brake linings 206 are secured to the outer arcuate sides of the brake shoes for frictional engagement with the inner surface 208 of an encircling portion of drive head housing 52. One end of each brake shoe is fixed to the driven hub by means of one of the pivot pins 200. The other end of each shoe is free to move inwardly under the influence of springs 204, or outwardly due to centrifugal force.

Figure 12:
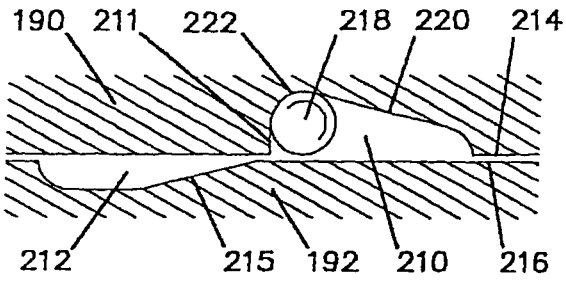
FIG. 12 is a partially broken, cross-sectional view illustrating ball actuating grooves formed in the driving and driven hubs of the centrifugal backspin retarder shown in FIG. 10 when operating in the forward direction.
Figure 13:
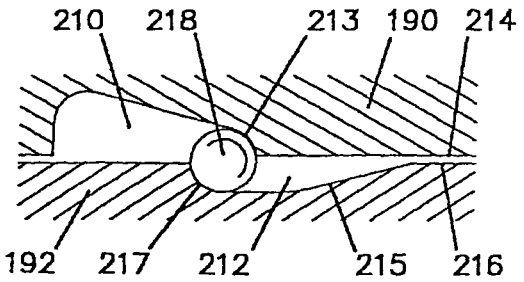
FIG. 13 is similar to FIG. 12 but illustrates the backspin retarder being driven in the backwards direction when the retarder brakes are engaged.

Referring to FIGS. 12 and 13, the driving and driven hubs 190 and 192 are formed with respective grooves 210 and 212, respectively, in adjacent surfaces 214 and 216, for receiving drive balls 218, of which only one is shown. Groove 210 in driving hub 190 is formed with a ramp or sloped surface 220 which terminates in a ball chamber 222 where it is intersected by a radial hole 209 in which the edge of the ball is located when drive shaft 54 rotates in a forward direction. Centrifugal force holds the ball radially outwards and upwards in the ball chamber by pressing it against radial hole 209 so there is no ball motion or contact with freewheeling driven hub 192 while rotation is in the forward direction. When the drive shaft rotates in the reverse direction, the ball moves downward to a position in which it engages and locks both hubs together.

When the drive head starts to turn in the forward direction, the ball 218 rests on driven hub 192. The edge 211 of ball chamber 222 pushes the ball to the right and causes it to ride up ramped surface 215. As the speed increases, the ball jumps slightly above the ramp and is thrown up into ball chamber 222, where it is held by centrifugal force as shown in FIG. 12.

When the electric motor turning the drive head is shut off, the drive head stops and ball 218 drops back onto driven hub 192 as windup in the sucker rod begins to counter or reverse rotate the drive head, which transmits the reverse rotation to drive shaft 54 through sleeve 80 and driven gear 76. More specifically, sloped surface 220 of driving hub 190 pushes the ball to the left until it falls into groove 212 of the driven hub. The ball continues to be pushed to the left until it becomes wedged between the spherical surface 213 of the driving hub and the spherical surface 217 of the driven hub thus starting the driven hub and thereby the brake shoes turning. This position is illustrated in FIG. 13. The reverse ramp 220 of driving hub 190 serves an important function associated with the centrifugal brake. The centrifugal brake has no friction against housing surface 208 until the brake turns fast enough to overcome brake retraction springs 204. If the driving hub generates a sufficient impact against driven hub 192 during engagement, the driven hub can accelerate away from the driving hub. If the driving hub is itself turning fast enough, the ball can rise up into ball chamber 222 and stay there. By adding reverse ramp 220, the ball cannot rise up during impact and since the ramp is relatively long, it allows driving hub 190 to catch up to driven hub 192 and keep the ball down where it can wedge between the driving and driven hubs.

Brake assembly 70 is preferably but not necessarily an oil brake with surface 208 (which acts as a brake drum) having, for example, parts for oil to enter or fall into the brake to reduce wear.

As will be appreciated, energy from the recoiling sucker rod is transmitted to brake 70 to safely dissipate that energy non-destructively.

A further aspect of the present invention is the provision of a polished rod lock out clamp 160 for use in securing the polished rod when it is desired to service the drive head. The clamp may be integrated into the drive head or may be provided as a separate assembly, which is secured to and between the drive head and a flow tee. FIGS. 14-17 illustrate two embodiments of a lock-out clamp.

Figure 14:
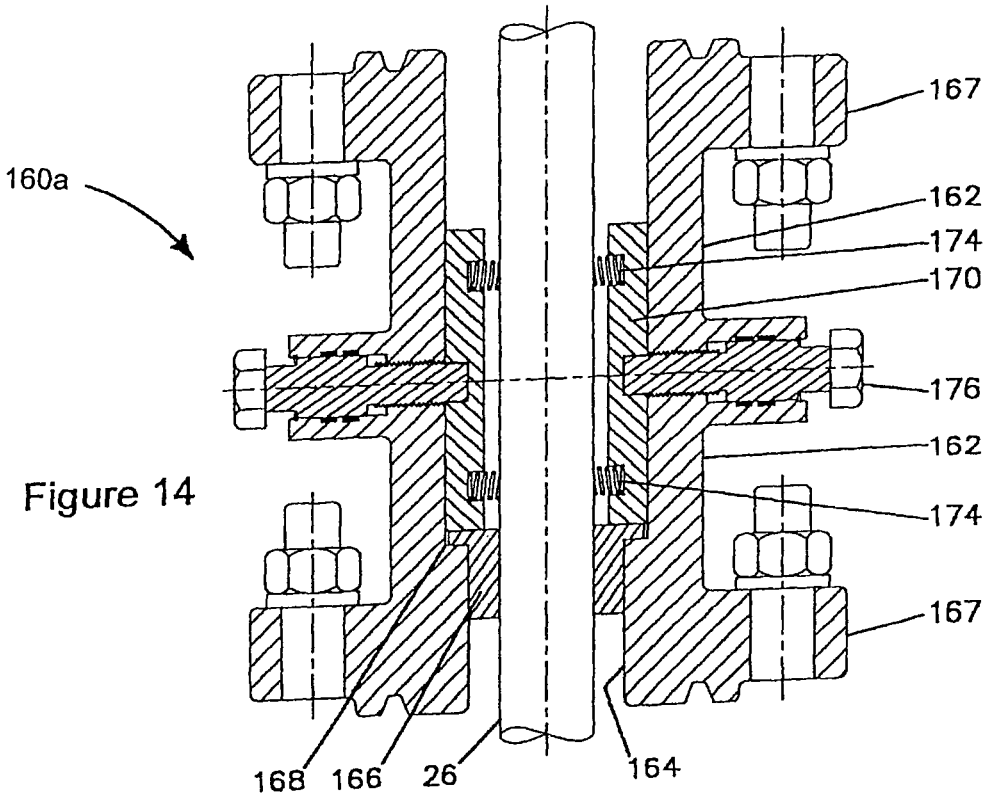
FIG. 14 is a side elevational, cross-sectional view of one embodiment of a polished rod lock-out clamp according to the present invention.
Figure 15:
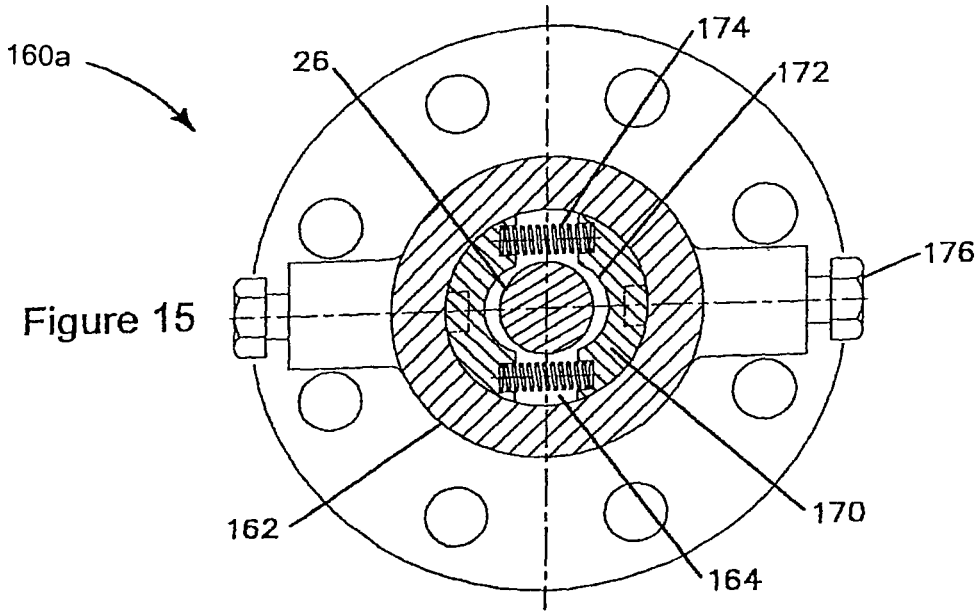
FIG. 15 is a top plan view of the clamp of FIG. 14.
Figure 16:
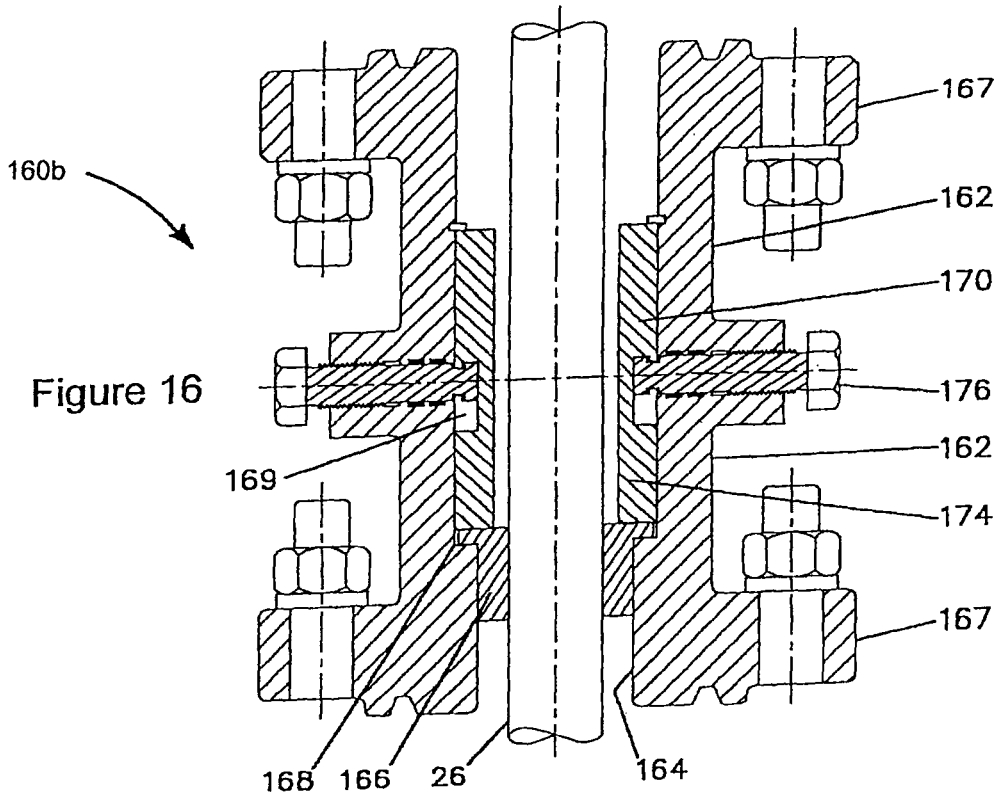
FIG. 16 is a side elevational, cross-sectional view of another embodiment of a polished rod lock-out clamp according to the present invention.
Figure 17:
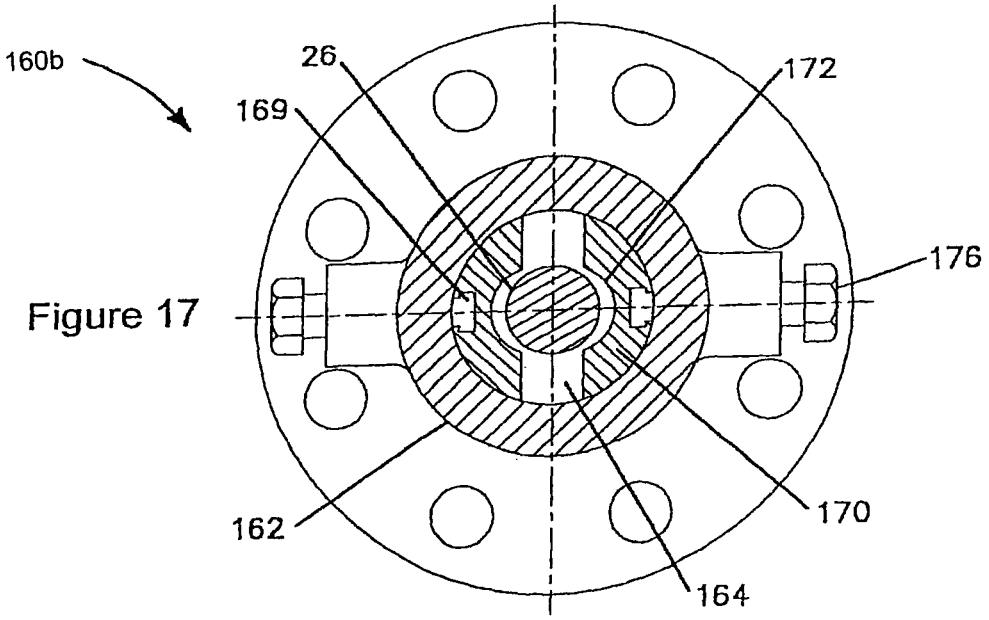
FIG. 17 is a top plan view of the claim of FIG. 16.

As shown, in each embodiment, the clamp includes a tubular clamp body 162 having a bore 164 for receiving polished rod 26 in annularly spaced relation therethrough. A bushing 166 is mounted on an annular shoulder 168 formed at the bottom end of bore 164 for centering the polished rod in the housing. Flanges 167 or threaded connections depending on the application are formed at the upper and lower ends of the housing for bolting or otherwise securing the housing to the underside of the drive head and to the upper end of the flow tee. The clamp includes two or more equally angularly spaced clamp members or shoes 170 about the axis of the housing/polished rod. The clamp shoes are generally in the form of a segment of a cylinder with an arcuate inner surface 172 dimensioned to correspond to the curvature of the surface of the polished rod. Arcuate inner surfaces 172 should be undersize relative to the polished rod's diameter to enhance gripping force. In the embodiment of FIGS. 14 and 15, spring means 174 are provided to normally bias the clamp members into an un-clamped position. In the embodiment of FIGS. 16 and 17, the ends of bolts 176 are generally T-shaped to hook into correspondingly shaped slots 169 in shoes 170 to positively retract the shoes without the need for springs 174.

Clamp shoes 170 are actuated by manipulating means such as radial bolts 176, for example, to frictionally and non-elastomerically clamp the polished rod in hard surface to hard surface contact such that it cannot turn or be displaced axially. The lock out clamp may be located between the flow tee and the bottom of the drive head. Alternately, it can be built into the lower bearing cap 86 of the drive head.

Figure 18:
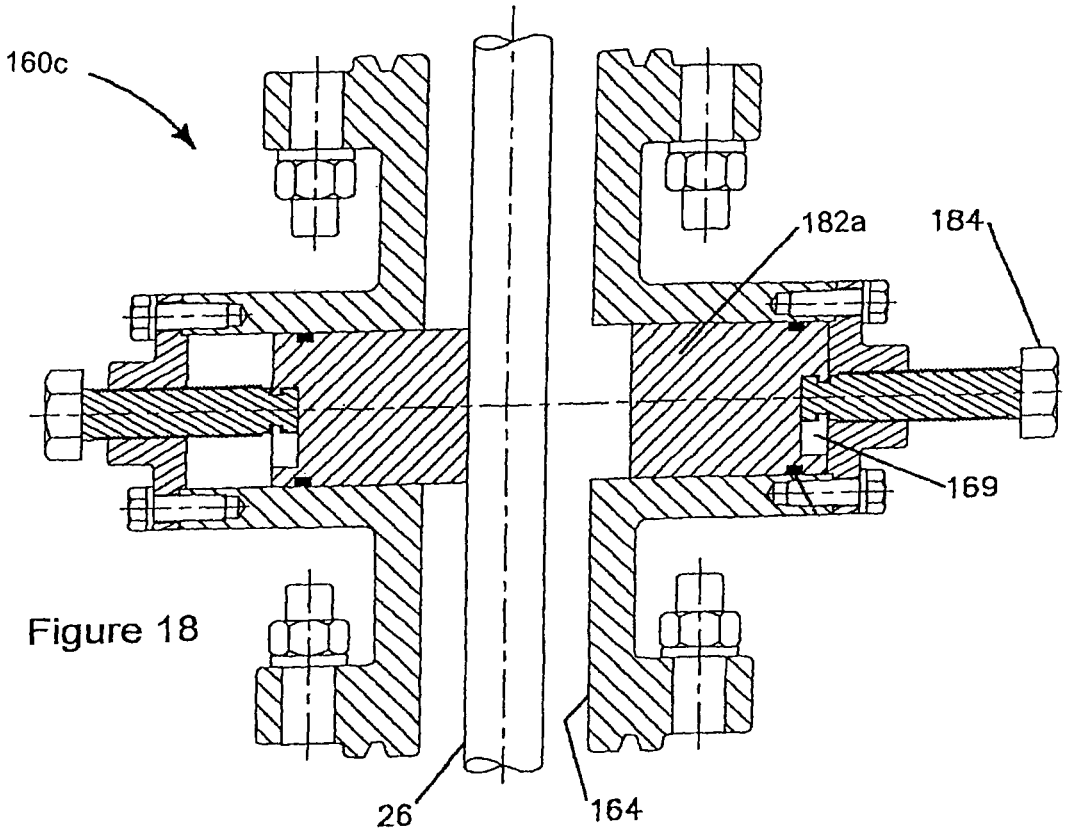
FIG. 18 is a side elevational, cross-sectional view of another embodiment of a polished rod lock-out clamp according to the present invention.
Figure 19:
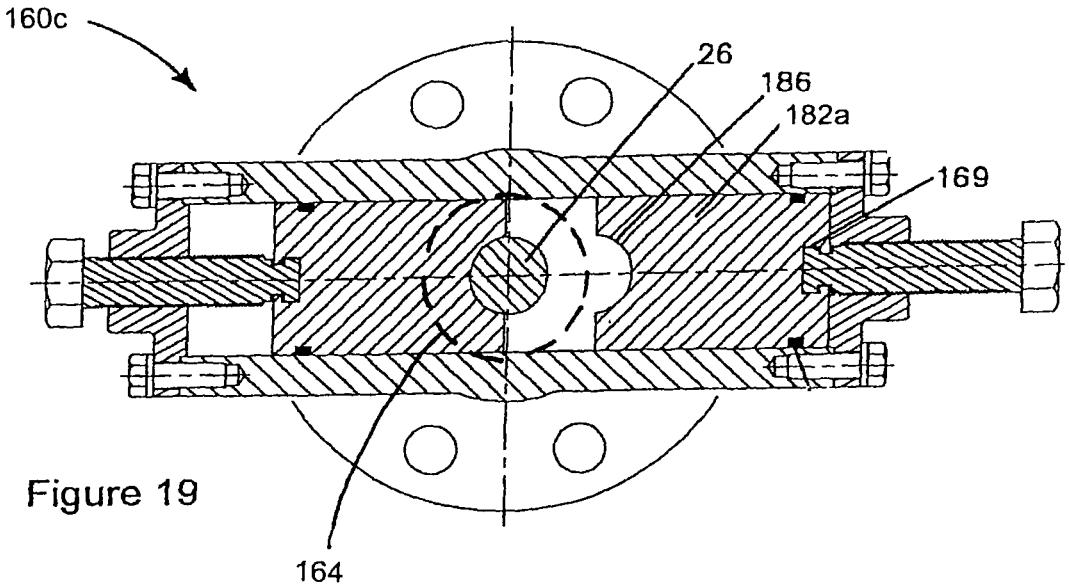
FIG. 19 is a top plan view of the clamp of FIG. 18.

In some applications it is preferable not to restrict the diameter through the bore 164 of the lock out clamp so that the sucker rods can be pulled through the clamp 160. In this embodiment of the polish rod clamp as shown in FIGS. 18 and 19, where like numerals identify like elements, two opposing radial pistons **182*a* are actuated by bolts 184 to force the pistons together and around polish rod 26. The polish rod is gripped by arcuate recesses 186, which are preferably made undersize relative to the polished rod to enhance gripping force. This embodiment provides means, such as piston bores, for axially locating the pistons 182*a*** in the body of the rod clamp and for transferring axial and rotational loads from the pistons to the rod clamp body.

Figure 20:
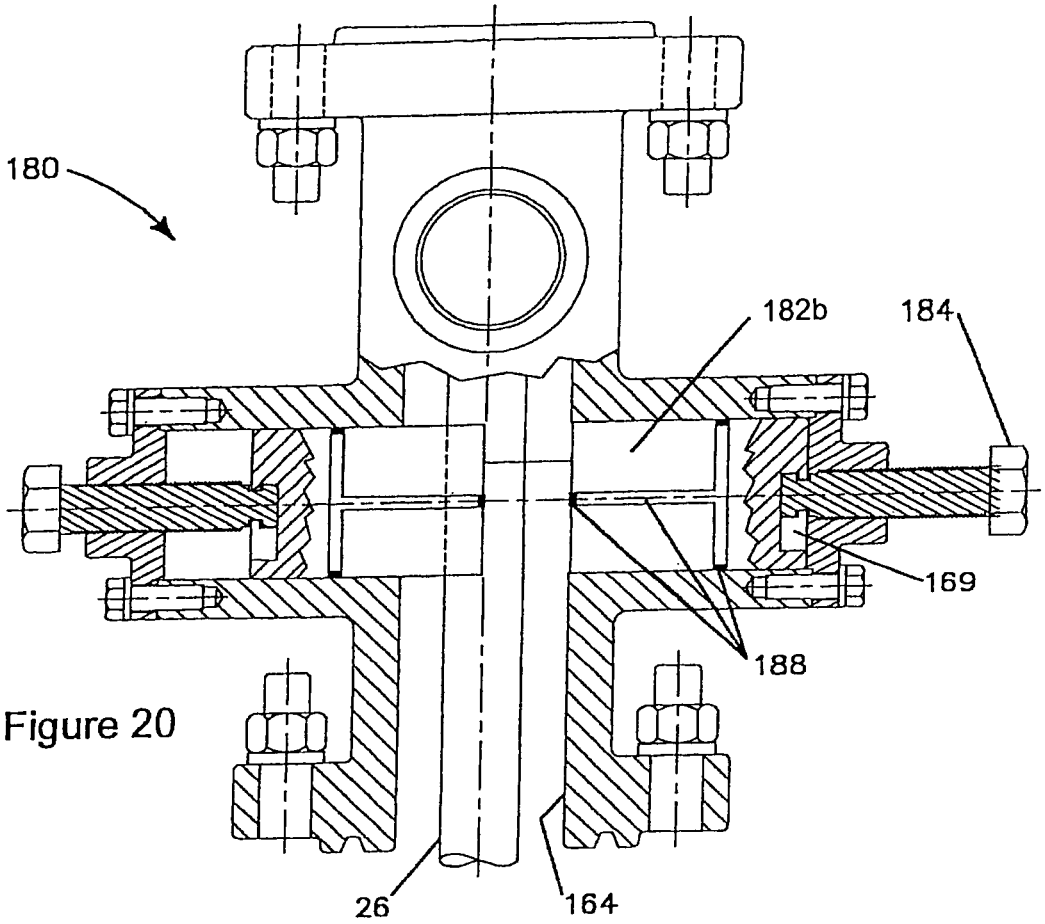
FIG. 20 is a side elevational, cross-sectional view of one embodiment of a blow-out preventer having an integrated polished rod lock-out clamp according to the present invention.
Figure 21:
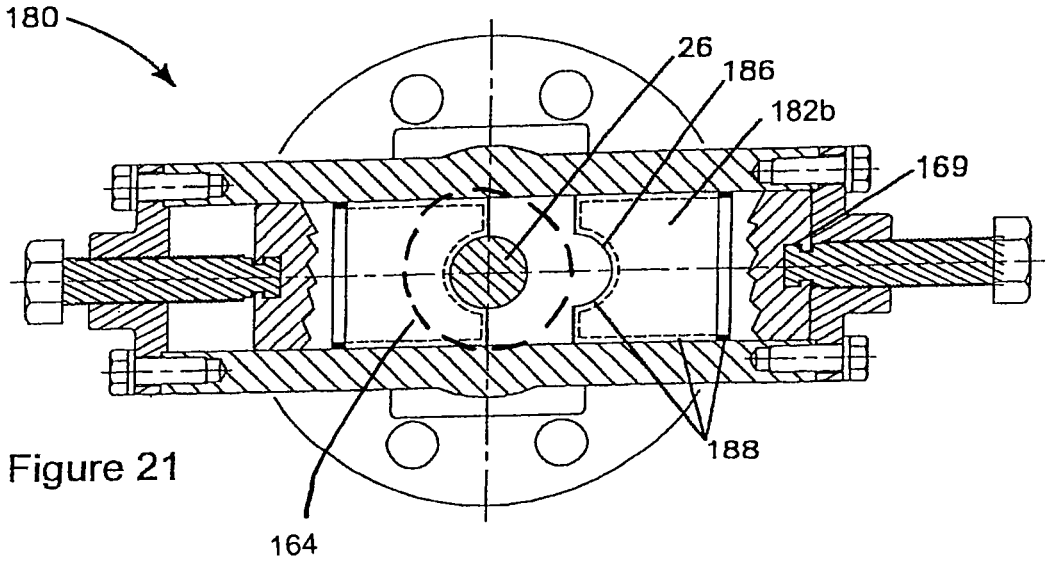
FIG. 21 is a top plan view of the clamp of FIG. 20.

In a further embodiment of the polished rod lock out clamp, the clamping means are integrated with a blow out preventer 180, shown in FIGS. 20 and 21. Blow out preventers are required on most oil wells. They traditionally have two opposing radial pistons actuated by bolts to force the pistons together at their end faces and around the polish rod to effect a seal. The pistons are generally made of elastomer or provided with an elastomeric liner such that when the pistons are forced together by the bolts, a seal is formed between the pistons, between the pistons and the polish rod and between the pistons and the piston bores. Actuation thus serves as a means to prevent well fluids from escaping from the well.

In accordance with the present invention, an improved blow out preventer serves as a lock out clamp for well servicing. In order to serve this purpose, the pistons must be substantially of metal which can be forced against the polished rod to prevent axial or rotational motion thereof. The inner end of the pistons is formed with an arcuate recess 186' defining a curved surface, with curvature corresponding substantially to that of the polished rod. Enhanced gripping force can be achieved if the arcuate recess diameter is undersize relative to the polished rod. The sealing function of the blow out preventer must still be accomplished. This can be done by providing a narrow elastomeric blow out preventer seal 188 which runs across the vertical flat face of the piston, along the arcuate recess, along the mid height of the piston and then circumferentially around the piston. Seal 188 seals between the pistons, between the pistons and the polish rod and between the pistons and the piston bores. Thus, well fluid is prevented from coming up the well bore and escaping while the well is being services, as might be the case while the stuffing box is being repaired. By including the sealing function of the BOP with clamping means, one set of pistons can accomplish both functions, enhancing safety and convenience without increasing cost or size.

The above-described embodiments of the present invention are meant to be illustrative of preferred embodiments and are not intended to limit the scope of the present invention. Various modifications, which would be readily apparent to one skilled in the art, are intended to be within the scope of the present invention. The only limitations to the scope of the present invention are set forth in the following claims appended hereto.

The invention claimed is:

1. A combined blow out preventer and polished rod lock out clamp for use in an oil well installation, comprising:

a housing having a bore for receiving a polished rod in spaced relation therethrough and opposed bores extending radially of said bore of said housing;

clamp members in said housing for grippingly and frictionally engaging said polished rod in said bore, each said clamp member comprising a piston disposed in one of said radial bores, each piston having a hard inner end and a concavely curved recess in said inner end for receiving and grippingly engaging said polished rod in non-elastomeric frictional contact along at least a portion of the length of said recess to suspend said polished rod in said oil well installation;

elastomeric seal means for providing a seal between a portion of the length of said recess in said piston and said polished rod, between said pistons, and between each piston and the associated radial bore to prevent well fluid from coming up a well bore and escaping to the exterior of the well bore when said pistons grippingly engage the polished rod; and manipulating means secured to said housing and said pistons for moving said pistons between a polished rod gripping position in which said pistons grippingly engage said polished rod to prevent rotation or axial movement thereof and a retracted position in which said pistons are removed from said polished rod to permit rotational and axial movement of said polished rod in said bore of said clamp housing.

2. The combined blow out preventer and polished rod lock out clamp as defined in claim 1, wherein said manipulating means include a bolt secured to each said piston, said bolts being threadedly engaged with radially extending threaded holes in said clamp body for radial movement of said bolts and said pistons, said bolts extending outwardly of said clamp body for manipulation thereof.

3. The combined blow out preventer and clamp as defined in claim 2, wherein each said bolt includes a shaped portion formed on an inner end thereof for mating engagement with a correspondingly shaped slot in a respective clamp member for moving said members into said retracted position thereof.

4. A combined blow out preventer and clamp as defined in claim 1 including resilient members disposed between said clamp members to normally bias said clamp members towards said retracted position thereof.

5. The combined blow out preventer and polished rod lock out clamp as defined in claim 1, wherein the diameter of said curved recess is slightly less than the diameter of the outer surface of a polished rod received through the bore of said housing.

6. The combined blow out preventer and polished rod lock out clamp as defined in claim 1, wherein said elastomeric seal means is mounted in a groove in said curved surface in each piston, and are compressible into said groove to allow said pistons to make non-elastomeric frictional contact with said polished rod when said pistons are in said gripping positions thereof.

7. A polished rod lock out clamp, with blow out preventer seals, operable to suspend a polished rod in an oil well installation, comprising:

a clamp body having an axial bore for receiving the polished rod in spaced relation to said bore;

two radially opposed pistons acting as clamp members, said clamp body having a piston bore for each said piston, each said piston bore extending radially of said axial bore of said clamp body, each said piston having a hard inner end proximate said axial bore of said clamp body, an arcuate inner surface being formed in said inner end for receiving and grippingly engaging said polished rod in frictional metal contact;

manipulating means secured to said clamp body and said clamp members for moving said pistons between a polished rod gripping position in which said pistons grippingly engage the polished rod to prevent rotation or axial movement of the polished rod and a retracted position in which said pistons are removed from the polished rod to permit rotational and axial movement of the polished rod in said axial bore of said clamp body; and said pistons each having one of said blow out preventer seals to seal between the polished rod and a portion of the length of said arcuate inner surface in each said piston, between said opposed pistons and between each said piston and its associated radial bore to prevent well fluids from escaping from a well bore, said blow out preventer seals being compressible to allow said pistons to make metal to metal contact with said polished rod when said pistons are in said gripping position thereof.

8. The clamp as defined in claim 7, wherein the radius of curvature of said arcuate inner surface is slightly less than the radius of curvature of the outer surface of a polished rod received through the axial bore of said clamp body.

9. The clamp as defined in claim 7, wherein each said blow out preventer seal is mounted in a groove in said arcuate inner surface in each piston, and is compressible into said groove to allow said pistons to make metal to metal contact with said polished rod when said pistons are in said gripping position thereof.

* * * * *